US005188255A

United States Patent [19]

Du

[11] Patent Number: 5,188,255

[45] Date of Patent: Feb. 23, 1993

[54] METHOD AND APPARATUS FOR FACILITATING THE CLEANING OF A SPRAY APERTURE IN A MIXING CHAMBER OF A NOZZLE

[76] Inventor: Benjamin R. Du, 32392 Via Antibes, South Laguna, Calif. 92677

[21] Appl. No.: 904,945

[22] Filed: Jun. 26, 1992

Related U.S. Application Data

[63] Continuation of Ser. No. 579,888, Sep. 7, 1990.

[51] Int. Cl.[5] ..... B67D 1/08

[52] U.S. Cl. ..... 222/1; 222/129.2; 222/145; 222/148; 239/106; 239/113

[58] Field of Search ..... 222/129.1, 129.2, 129.3, 222/129.4, 145, 148, 1; 239/106, 113, 420, 421, 543-545

[56] References Cited

U.S. PATENT DOCUMENTS

| | | | |
|---|---|---|---|
| 3,211,377 | 10/1965 | Brenner | 239/106 X |
| 3,764,041 | 10/1973 | Noll | 222/148 X |
| 3,800,826 | 4/1974 | McCann | 222/129.1 X |
| 3,869,068 | 3/1975 | Chen | 222/148 X |
| 3,876,144 | 4/1975 | Madden et al. | 239/106 |
| 4,218,014 | 8/1980 | Tracy | 239/106 |
| 4,349,130 | 9/1982 | Bair | 222/129.2 |
| 4,388,338 | 6/1983 | Wittenborg | 222/129.1 X |
| 4,509,690 | 4/1985 | Austin et al. | 222/129.1 X |
| 4,753,370 | 6/1988 | Rudick | 222/129.1 X |
| 4,863,068 | 9/1989 | Smith | 222/129.1 |
| 4,928,854 | 5/1990 | McCann et al. | 239/106 X |
| 4,957,220 | 9/1990 | Du | 222/129.1 X |
| 5,002,204 | 3/1991 | Sakai | 222/129.1 |

FOREIGN PATENT DOCUMENTS

| | | | |
|---|---|---|---|
| 2462387 | 3/1981 | France | 222/148 |

*Primary Examiner*—Kevin P. Shaver
*Attorney, Agent, or Firm*—Stetina and Brunda

[57] ABSTRACT

A method and apparatus for mixing and dispensing two fluids from a nozzle comprises a mixing chamber for the two fluids defined by the nozzle. A first fluid of the two fluids is sprayed into the mixing chamber from a first aperture within the nozzle and a second fluid from a second aperture within the nozzle is sprayed into the mixing chamber. The second aperture is oriented in a direction within the nozzle such that the fluid dispensed therefrom is incident upon the first aperture for cleaning the first aperture.

6 Claims, 3 Drawing Sheets

METHOD AND APPARATUS FOR FACILITATING THE CLEANING OF A SPRAY APERTURE IN A MIXING CHAMBER OF A NOZZLE this application is a continuation of application Ser. No. 07/579,888, filed Sep. 7, 1990, pending.

FIELD OF THE INVENTION

The present invention relates generally to pumps and more particularly to a proportioning pump comprising a first piston and cylinder, a second piston and cylinder, a shaft connecting the first and second pistons, a spring for biasing the first and second pistons in a first position, a shuttle valve for controlling flow through the first cylinder, and two check valves for controlling flow through the second cylinder. The proportioning pump can be used to provide a cost effective means of dispensing carbonated water or the like and a flavored syrup in fixed proportions to insure the quality of a beverage thus produced. An accumulator is used to provide even flow of the carbonated water. A unique arrangement of the carbonated water and syrup nozzles prevents the buildup of syrup at the dispenser nozzle openings, thus insuring that proper flow of both fluids is maintained.

BACKGROUND OF THE INVENTION

As is well known, a variety of beverages are marketed to retail consumers by dispensing systems which simultaneously deliver a metered quantity of flavored syrup with a proportional quantity of carbonated water or the like. Due to sanitation and economic concerns, the beverage industry typically supplies these flavored syrups in collapsible bag-in-box containers which are adapted to be connected to suitable prior art dispensing systems.

The majority of the prior art dispensing systems utilize low flow rate pumps for drawing the syrup from the bag container to supply a metered quantity of the syrup to a mixing nozzle. The use of such low flow rate pumps has improved system reliability.

Syrups are normally concentrated and mixed with relatively large volumes of carbonated water. Therefore, undesired small variations in the relative quantity of carbonated water or syrups supplied will produce wide variations in the taste and quality of the final mixed product.

Although prior art dispensing systems have generally proven suitable for their intended purposes, they possess inherent deficiencies which have detracted from their overall effectiveness and use in the trade. Foremost among these deficiencies is the inability of prior art dispensing systems to precisely regulate the volume of the two fluids being dispensed. Prior art dispensing systems generally meter the two fluids by attempting to regulate their respective flow rates. The regulation of fluid flow rate has the inherent deficiency that the volume of fluids thus dispensed is dependent upon their respective pressures, viscosities, and temperatures. Therefore, attempts to control the flow of fluids thus dispensed is not sufficient to insure the quality of the beverages thus produced.

Since the quality of the beverage is dependent primarily upon the ratio of the flavored syrup to the carbonated water used to produce the beverage and since small variations in this ratio can produce wide variations in the taste of the beverage, it is therefore desirable to regulate this ratio as precisely as possible. Thus, there exists a substantial need in the art for a reliable, relatively inexpensive apparatus and method for dispensing flavored syrup and carbonated water or the like in fixed proportions to insure the quality of the beverage thus produced.

SUMMARY OF THE INVENTION

The present invention specifically addresses and alleviates the above-mentioned deficiencies associated in the prior art. More particularly, the present invention comprises a proportioning pump having a first piston and cylinder, a second piston and cylinder, a shaft connecting the first and second pistons, a spring for biasing the first and second pistons in a first portion, a shuttle valve for controlling flow through the first cylinder, and two check valves for controlling flow through the second cylinder.

The proportioning pump is used to dispense a predetermined ratio of two fluids. A pressurized first fluid fills the first cylinder and forces the first piston to move to a second position. The motion of the first piston is communicated to the second piston via the shaft, causing the second piston to likewise move to a second position. Movement of the second piston draws the second fluid through a check valve into the second cylinder When both the first and second cylinders are full, i.e. they have completed their intake stroke, the shuttle valve closes the inlet to the first cylinder and opens the outlet. The spring then urges the first and second pistons back to their first positions, thus forcing the two fluids from their respective cylinders. The two check valves prevent reverse flow through the second cylinder.

The pressurized first fluid provides the energy to drive the proportioning pump. A given volume of first fluid drives the first piston within the first cylinder and causes a proportional volume of a second fluid to be pumped through the second cylinder.

The ratio of the volume of the two fluids being pumped can be varied by changing the size of the second cylinder and piston. Second cylinders of various volumes can be provided to permit the dispensing of various ratios of first and second fluids.

The proportioning pump can be used to provide a cost effective means of dispensing carbonated water or the like and a flavored syrup in fixed proportions to insure the quality of a beverage thus produced.

An accumulator may be used between the proportioning pump's first cylinder outlet and the dispensing nozzle to reduce the effect of the pulsations caused by the pumping action of the first piston upon the carbonated water. The accumulator smooths out these pulsations to provide a more even flow of carbonated water or the like through the dispensing nozzle It is not necessary to have an accumulator for the proportioning pump's second cylinder since the flow of the syrup is considerably less than the flow of the carbonated water.

A unique arrangement of the carbonated water and syrup nozzles prevents the buildup of syrup at the nozzle openings, thus insuring that proper flow of both fluids is maintained. This unique arrangement of dispensing nozzles also provides for the thorough mixing of the carbonated water with the flavored syrup as it exits the dispensing nozzle.

DETAILED DESCRIPTION OF THE PREFERRED EMBODIMENT

The proportioning pump of the present invention is illustrated in FIGS. 1–9 which depict a presently preferred embodiment of the invention for use in a beverage dispensing fountain.

Figure 1:
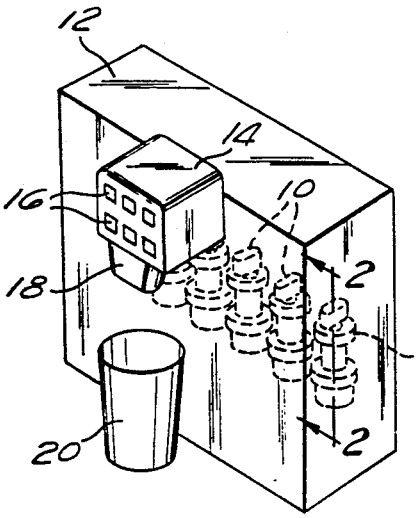
FIG. 1 is a perspective view of a beverage dispensing fountain showing a plurality of proportioning pumps disposed therein.
Figure 8:
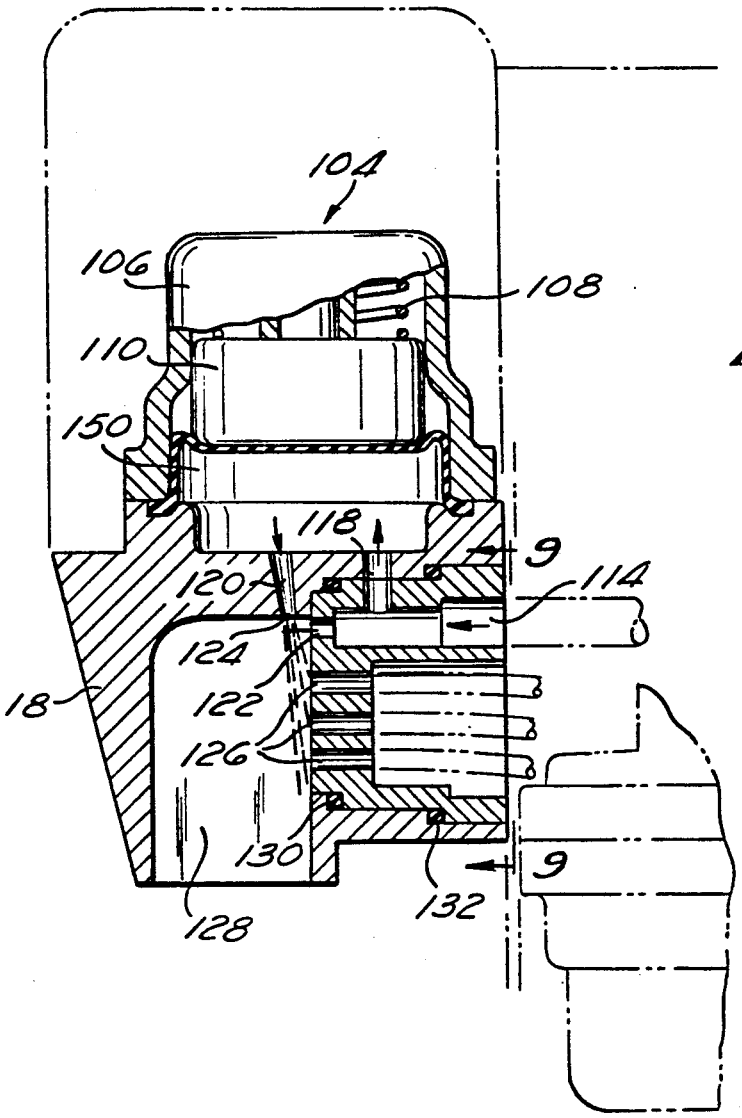
FIG. 8 is a cross-sectional side plan view of the dispensing nozzle of the present invention showing the accumulator and the fluid dispensing apertures.

Referring now to FIG. 1, soft drinks may be dispensed from a soft drink dispensing fountain by disposing a cup 20 beneath the dispensing nozzle 18 and then pressing one of the selector buttons 16. Pressing a selector button 16 closes a microswitch which actuates a solenoid valve (not shown) to cause pressurized carbonated water or the like to flow to a proportioning pump 10 of the present invention. A plurality of proportioning pumps 10 may be installed within a beverage fountain 12 to provide for the precise dispensing of predetermined ratios of carbonated water or the like and various flavored syrups. Each selector button 16 actuates a different solenoid valve and causes carbonated water and syrup to flow through a separate proportioning pump to form a different soft drink. That is, each selector button 16 and proportioning pump 10 will typically be associated with a different soft drink. Each proportioning pump 10 is driven by the pressurized carbonated water or the like and delivers a proportional quantity of carbonated water and a flavored syrup to the nozzle 18 where the carbonated water and syrup mix to form a soft drink. The carbonated water may flow through an accumulator, as shown in FIG. 8, to dampen pressure fluctuation, prior to entering the nozzle 18.

Figure 2:
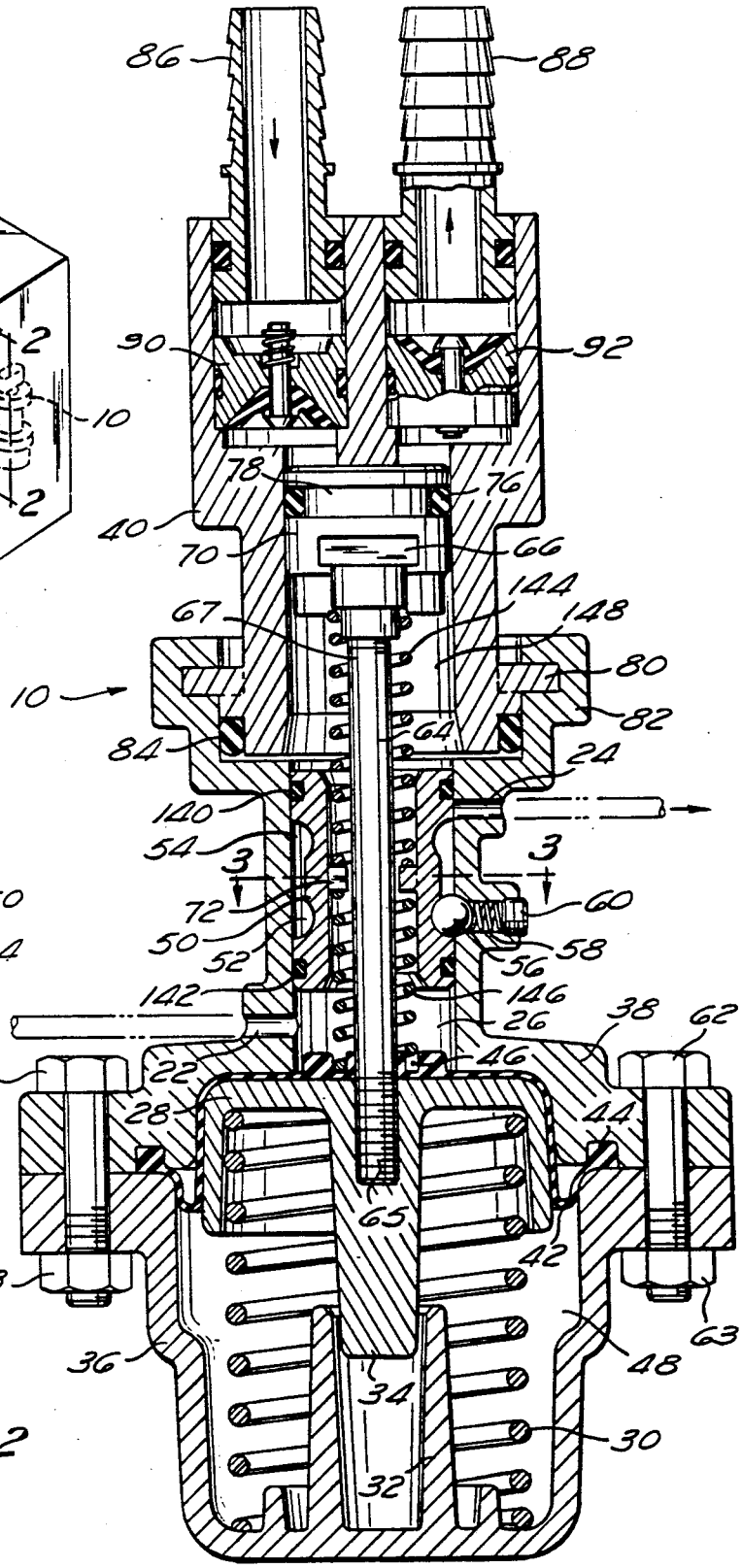
FIG. 2 is an enlarged cross-sectional side plan view of a single proportioning pump of the present invention.

Referring to FIG. 2, a cross-sectional view of a single proportioning pump of the present invention is illustrated. The proportioning pump, according to the preferred embodiment of the present invention, includes upper and lower housing sections 38 and 36 bolted together with bolts 62 and nuts 63 thus forming first housing 39. Lowermost or first piston 28 is disposed with cavity 48 formed within the first housing 39. First piston 28 is biased in an uppermost or first position by spring 30. First piston 28 can reciprocate in an up and down motion which is constrained by follower 34 and guide 32. A diaphragm seal 42 is captured about its periphery 44 between upper 38 and lower 36 housing sections. A shaft 64 attaches the first Piston 28 to a second piston 70. The lower end 65 of shaft 64 is threaded into a threaded opening in the first piston 28. The upper end 67 of shaft 64 is likewise threaded and screws into T-slide connector 66. T-slide connector 66 detachably attaches shaft 64 to second piston 70. An inlet 22 formed in upper housing section 38 of first housing 39 provides for fluid communication into a first cylinder 26 formed within upper housing section 38. Outlet 24 provides for fluid communication out of first cylinder 26 formed in upper housing section 38 of first housing 39.

The first cylinder 26 is that volume within the lower housing section 36 and upper housing section 38 which can be filled with fluid to force first piston 28 downward. The first cylinder 26 also includes the volume occupied by first piston 28. The first cylinder therefore includes a portion of cavity 48.

Shuttle valve 50 is positioned for reciprocal movement within first cylinder 26 such that when shuttle valve 50 is in its first or uppermost position it prevents fluid flow out of first cylinder 26 through outlet 24 and permits fluid flow into first cylinder 26 from inlet 22. When shuttle 50 is in its second or lowermost position, it prevents fluid flow into first cylinder 26 from inlet 22 and permits fluid flow out of first cylinder 26 through outlet 24. Upper 54 and lower 52 recesses formed in shuttle valve 50 cooperate with detent or ball 56 and spring 58 to temporarily lock shuttle valve 50 in its uppermost and lowermost positions. Screw 60 secures ball 56 and spring 58 within upper housing section 38.

Upper 140 and lower 142 shuttle valve seals are disposed within grooves about the uppermost and lowermost peripheries respectively of shuttle valve 50. Seals 140 and 142 isolate the pressurized first cylinder 26 from the outlet 24 when the shuttle valve 50 is in its uppermost position. This prevents fluid flow out of the first cylinder 26 through the outlet 24 as the first cylinder 26 fills with fluid. The seals 140 and 142 also isolate the first cylinder 26 from the inlet 22 when the shuttle valve 50 is in its lowermost position and the first piston 28 is forcing fluid out of the first cylinder 26. This prevents fluid flow out of the first cylinder 26 through the inlet during the exhaust stroke of the first piston 28.

Upper 144 and lower 146 shuttle biasing springs urge the shuttle 50 into its uppermost or lowermost position, depending upon the position of first 28 and second 70 pistons. Upper shuttle biasing spring 144 is disposed about shaft 64. The upper end of upper shuttle biasing spring 144 abuts the lowermost surface of second piston 70 and the lowermost end of upper shuttle biasing spring 144 is received by shuttle valve 50 and abuts spring stops 72 formed within shuttle valve 50. Lower shuttle biasing spring 146 is likewise disposed about shaft 64. The upper end of lower shuttle biasing spring 146 abuts spring stops 72 and the lowermost end of lower shuttle biasing spring 146 is received by groove 46 formed in seal 42.

Figure 4:
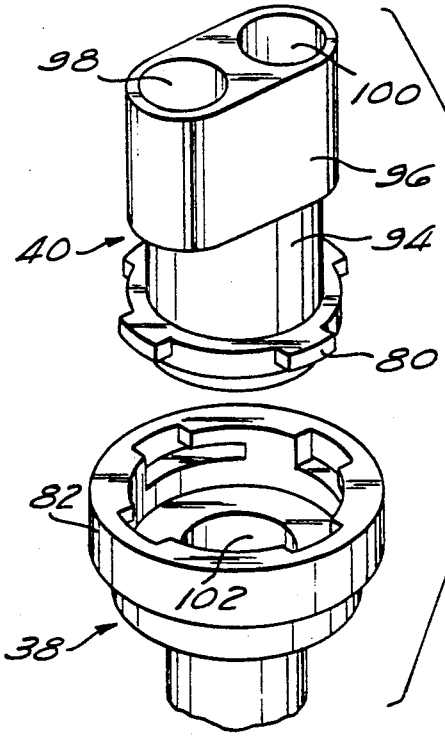
FIG. 4 is a perspective view of the removable head assembly showing the bayonet connectors used to attach the head assembly to the proportioning pump.

Second or head housing 40 is received by and removably attached to upper housing section 38. Bayonet latch male member 80 is captured by bayonet latch female member 82 (as best seen in FIG. 4).

Second cylinder 148 formed within head housing 40 receives the second piston 70 which is positioned for reciprocal movement in an up and down direction. Second piston 70 is connected to first piston 28 via shaft 64 and therefore moves in unison with first piston 28. Seal 76 disposed in groove 78 of second piston 70 prevents fluid leakage past second piston 70 into first cylinder 26. Second piston 70, as illustrated in FIG. 2, is in its first or uppermost position, therefore a cavity will be formed within cylinder 148 above second piston 70 when second piston 70 is in its second or lowermost position.

Inlet 86 provides fluid communication through inlet check valve 90 into second cylinder 148. Outlet 88 provides fluid communication out of second cylinder 148 through outlet check valve 92.

The upper housing 38, lower housing 36, first piston 28, and shuttle valve 50 thus comprise a first positive displacement pump. The head housing 40, second piston 70, and check valves 90 and 92 thus comprise a second positive displacement pump. The first positive displacement pump is driven by a pressurized first fluid such as carbonated water. The first positive displacement pump meters the first fluid and also drives the second positive displacement pump. While the first positive displacement pump does not actually pump the first fluid, it is referred to in this application as a pump because of its structural similarity to a pump. Indeed, it is contemplated that a pair of positive displacement pumps may be mechanically linked and plumbed to practice the present invention. The use of a positive displacement pump instead of a non-positive displacement pump is required to assure that constant volumetric proportions of the first and second fluids are delivered.

Figure 3:
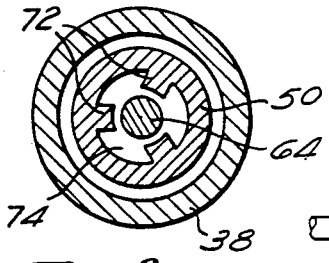
FIG. 3 is a cross-sectional view taken along line 3 of FIG. 2.

Referring now to FIG. 3, a top sectional plan view of the shuttle valve 50 and the shaft 64 within the upper housing section 38 is provided Spring stops 72 formed upon the interior surface of shuttle valve 50 abut both the upper 144 and lower 146 shuttle biasing springs to provide for positive positioning of the shuttle valve 50. This prevents the shuttle valve 50 from coming to rest midway between its first and second operative positions, thereby preventing any stalling of the proportioning pump. Shuttle valve void 74 permits fluid flow through the shuttle valve 50 from the lower portion of first cylinder 26 into the upper portion of first cylinder 26.

Referring now to FIG. 4, the attachment of the head housing 40 to the upper housing section 38 by bayonet latch male member 80 and bayonet latch female member 82 is illustrated. Head housing 40 is attached to upper housing section 38 by inserting bayonet latch male member 80 into the corresponding bayonet latch female member 82 and rotating clockwise. Bayonet latch seal 84, shown in FIG. 2, prevents fluid leakage from the interface of head housing 40 and upper housing section 38. The use of the bayonet connector comprised of male member 80 and female member 82 facilitates the easy and rapid changing of the head housing 40 and the second piston 70 to permit varying of the volumetric proportion of the first and second fluids delivered.

Figure 5:
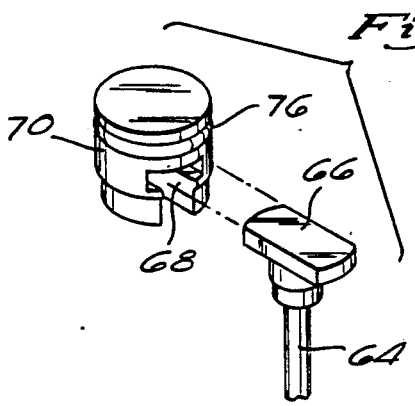
FIG. 5 is a perspective view of the second fluid piston showing its connection means to the shaft.

Referring now to FIG. 5, the attachment of second piston 70 to shaft 64 is illustrated. Second piston 70 has a T-slot 68 which receives T-slide connector 66. T-slide connector 66 is attached to or formed upon shaft 64. The use of T-slide connector 66 to attach second piston 70 to shaft 64 provides for the easy replacement of second piston 70 with a piston of a different diameter. Replacing head housing 40 and second piston 70 permits the ratio of the first and second fluids pumped through the proportioning to be varied. Thus, soft drinks can be dispensed having various ratios of carbonated water or the like to syrup.

The ratio of the first and second fluids metered through a proportioning pump is varied by providing a replacement head housing 40 with a cylinder 148 having a different capacity from the original cylinder. A corresponding piston 70 must be utilized which properly fits the cylinder.

Changing the diameter of the piston 70 and the second cylinder 148 changes the ratio of the first and second fluids delivered by the proportioning pump. This occurs because the volume of the second cylinder 148 and consequently its flow capacity are thereby changed.

Since the flow capacity of the second cylinder 148 is changed and the flow capacity of the first cylinder remains unchanged, the ratio of the two fluids delivered must change. This ratio can therefore be varied to accommodate differing concentrations of first and second fluids and differing desired ratios of the first and second fluids in the final product. Differing concentrations require varying the ratio of the two fluids delivered by the proportioning pump so that a consistent taste can be achieved in the final product. For instance, less of a more concentrated syrup would need to be pumped. Differing desired ratios of the first and second fluids in the final product can result from a need to accommodate the differing tastes of consumers. For instance, consumers in one region may prefer a higher concentration of syrup than do consumers in a different region.

Because of the modular design of the proportioning pump 10 of the present invention, it is a simple matter to change the head housing 40 and piston 70. The inlet and outlet hoses (not shown) are first removed from the inlet 86 and outlet 88 of the head housing 40. Then the head housing 40 is rotated counterclockwise as viewed in FIG. 4 and pulled away from the upper housing 38 to disconnect the bayonet male member 80 of the head housing 40 from the bayonet female member 82 of the upper housing 38. Removal of the head housing 40 from the proportioning pump 10 exposes the second piston 70. The second piston 70 is removed from the shaft 64 by sliding it laterally off of the T-slide connector 66.

A new piston 70, having a different diameter, is slid laterally onto the T-slide connector 66. A new head housing 40, having a cylinder 148 sized to receive the new piston 70, is slid over the new piston 70. Thus, the new piston 70 is received into the cylinder 148 of the new head housing 40. The male bayonet member 80 is inserted into the female bayonet member 82 and rotated clockwise as viewed in FIG. 4 to complete the installation.

Figure 6:
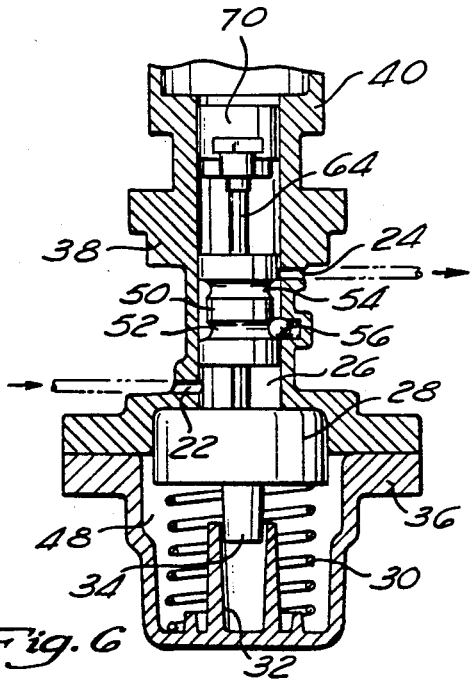
FIG. 6 is a cross-sectional side plan view of the proportioning Pump having the shuttle valve, first fluid piston, and second fluid piston disposed in their first positions, ready for the intake of the first and second fluids.
Figure 7:
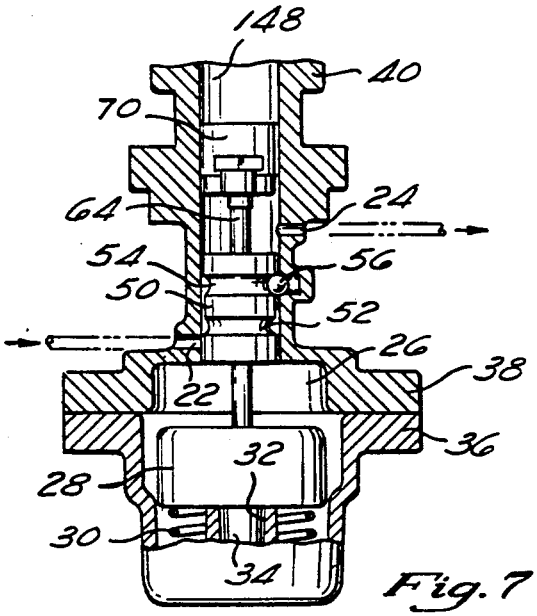
FIG. 7 is a cross-sectional side plan view of the proportioning pump having the shuttle valve, first fluid piston, and second fluid piston disposed in their second positions, as when both cylinders have been filled with their respective fluids.

Having thus described the structure of the proportioning pump, the operation thereof is now described in detail with particular reference to FIGS. 6 and 7.

FIG. 6 depicts the proportioning pump in its initial or pre-operational configuration with the first piston 28 and second piston 70 disposed in their first or uppermost positions. When a pressurized first fluid such as carbonated water is supplied to inlet 22, the first fluid enters the proportioning pump and fills first cylinder 26, thereby forcing first piston 28 to translate downward into cavity 48 against the urging of spring 30 to its lowermost position as shown in FIG. 7. As the first piston 28 translates downward, the volume of first cylinder 26 expands and occupies a portion of cavity 48.

Diaphragm seal 42 (shown in FIG. 2) prevents the first fluid from leaking into the remainder of cavity 48. Shuttle valve 50 prevents the first fluid from flowing out of first cylinder 26 through outlet 24.

The downward motion of first piston 28 is communicated through shaft 64 to second piston 70 which likewise translates downward to its second or lowermost position as illustrated in FIG. 7. As the second piston 70 moves downward, a second fluid such as flavored syrup is drawn into second cylinder 148 through inlet check valve 90. Outlet check valve 92 prevents the second fluid from being drawn into second cylinder 148 through outlet 88. The downward motion of second piston 70 causes the lower surface of second piston 70 to contact the upper surface of shuttle valve 50, thus forcing shuttle valve 50 from its first or uppermost position, as illustrated in FIG. 6, to its second or lowermost position, as illustrated in FIG. 7.

With the shuttle valve 50 in its lowermost position, the flow of the first fluid through inlet 22 is terminated, i.e. valved by the shuttle valve 50, and outlet 24 is opened. Spring 30 urges first fluid piston 28 back toward its first or uppermost position, thus forcing the first fluid out of first cylinder 26 through the outlet 24. Simultaneously, the upward motion of first fluid piston 28 is communicated to second piston 70 through shaft 64, causing the second fluid held within second cylinder 148 to be forced through outlet check valve 92 and outlet 88. Inlet check valve 90 prevents fluid flow out through inlet 86.

As such, during repetitive cyclic operation of the proportioning pump the first fluid drives the first 28 and second 70 pistons which in turn deliver proportional quantities of the first and second fluids. During repetitive cyclic operation the first fluid is metered through the first cylinder 26 and the second fluid is simultaneously metered through the second cylinder 148. Thus, each quantity of first fluid metered through the first cylinder 28 is accompanied by a proportional quantity of second fluid simultaneously metered through the second cylinder 148. Every cycle of the proportioning pump therefore delivers proportional quantities of first and second fluids. The first and second fluids, typically carbonated water and a flavored syrup, mix at the nozzle 18, of FIG. 1, and are dispensed into a cup 20. The pressurized first fluid therefore provides the energy to drive the proportioning pump, this completely eliminating the need for a separate drive motor.

Each cycle of the proportioning pump of the present invention delivers a discrete volume of the first and second fluids. The volume of fluids delivered is dependent upon the volumes of the first and second cylinders. The temperature, pressure, and viscosity of the fluids being pumped do not have a significant effect upon the volume of the fluids delivered by the proportioning pump. Thus, a more consistent ratio of first and second fluids is possible in the dispensed beverage Referring now to FIG. 8, an accumulator 104 and nozzle 18 are depicted. The accumulator 104 smooths out the pulsations in the flow of the first fluid caused by the reciprocal pumping action of the first piston 28. While the pulsations in the flow of the first fluid are in no way harmful and do not adversely affect the operation of the proportioning pump, such pulsations are annoying to the operator of the beverage dispensing fountain 12. It is therefore desirable that such fluctuations be minimized. The accumulator 104 comprises an accumulator piston 110, a diaphragm seal 112, and an accumulator spring 108.

The first fluid enters the nozzle 18 through first fluid inlet 114 from which the first fluid can enter mix chamber 128 or accumulator 104. A restriction in the flow path of the first fluid occurs at the first fluid aperture 122. This restriction forces a portion of the first fluid to flow through accumulator inlet 118 and into accumulator cavity 150, thereby forcing accumulator piston 110 upward, compressing accumulator spring 108. When the first fluid pressure decreases within first fluid inlet 114, such as between pulses, the piston 110 of accumulator 104 is urged downward by spring 108, thus forcing the first fluid out of cavity 150 through accumulator outlet 120.

The first fluid sprays out of accumulator aperture 124 onto second fluid apertures 126, thereby washing any excess second fluid from the second fluid apertures 126 to prevent accumulation of the second fluid thereon. Accumulation of the second fluid upon the second fluid apertures 126 can result in improper operation of the corresponding proportioning pump 10 due to back pressure caused at the second fluid outlet 88. This occurs when the accumulation of the second fluid obstructs a second fluid spray nozzle 126.

Obstruction is possible because of the concentration of the second fluid typically found in flavored syrups and the like. When such a second fluid is permitted to accumulate and then dry out, the resulting residue is very thick and sticky. As more of the second fluid accumulates and further evaporation takes place, obstruction can easily occur. This typically requires partial disassembly of the nozzle 18 and cleaning of the second fluid spray apertures 126. Therefore, it is desirable that the second fluid spray nozzles remain clean and unobstructed.

Back pressure at the second fluid outlet 88 causes improper operation of the proportioning pump because it reduces the rate at which the second fluid can be exhausted from the second cylinder 148. This also reduces the rate at which the first fluid can be exhausted from the first cylinder 26, since the first 28 and second 70 pistons are connected by the shaft 64. This results in reduced efficiency of the pumping process, since the flow of both fluids is reduced. Thus, the accumulation of the second fluid upon the second fluid spray apertures 126 can reduce the rate at which a beverage is dispensed.

The first fluid entering mix chamber 128 through accumulator aperture 124 and first fluid aperture 122 mixes with the second fluid from apertures 126 to form a beverage containing the desired proportion of first and second fluids. Generally, only one of the second fluid apertures 126 will be in use at any given time.

Figure 9:
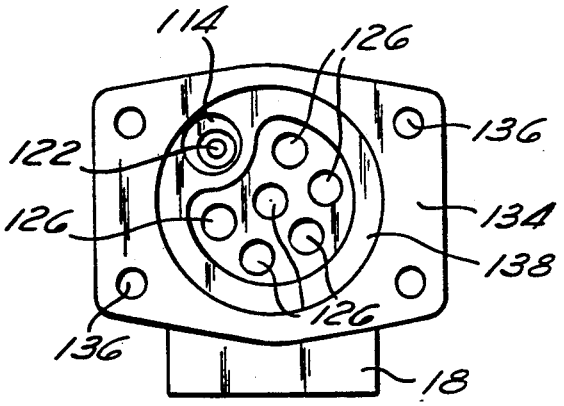
FIG. 9 is a side plan view taken along line 9 of FIG. 8 showing the fluid dispensing apertures.

Referring now to FIG. 9, a plan side view of the nozzle 18 taken along line 9 is illustrated. The nozzle 18 is mounted to the beverage fountain by bolting it in place using bolt holes 136. The second fluid enters the nozzle 18 through second fluid apertures 126. Each of the second fluid apertures 126 can be used for a separate second fluid. For example, a variety of different flavored syrups can be used as second fluids with carbonated water being used as the first fluid to form a variety of different beverages.

The first fluid enters the nozzle 18 through first fluid inlet 114. The restriction at the first fluid aperture 122 forces a portion of the first fluid into the accumulator 104.

The first fluid outlets 24 of each of the proportioning pumps 10 of FIG. 1 are connected together with a first manifold (not shown) The first manifold has a single outlet through which the first fluid may be communicated from any proportioning pump to the first fluid inlet 114 of the nozzle 18. The activation of a proportioning pump 10 causes the first fluid from that proportioning pump 10 to flow through the first manifold to the first fluid inlet 114 of the nozzle 18. The first fluid does not flow into other proportion pumps 10 because those proportioning pumps 10 which are not being used to supply first fluid to the first manifold have their shuttle valves 50 in the first or uppermost position, thus preventing the flow of the first fluid from the first manifold into the proportioning pump 10.

The second fluid outlets 88 of each of the proportioning pumps 10 of FIG. 1 are connected directly to their respective second fluid inlets 116. Therefore, the second fluid is communicated directly from each proportioning pump to the nozzle 18, where it mixes with the first fluid to form a soft drink. The second fluid is sprayed into the mix chamber 128 of the nozzle 18 through apertures 126.

A second manifold (not shown) supplies the first fluid to each proportioning pump 10 from a pressurized container (not shown). The second manifold has a single inlet which is connected to the pressurized container of first fluid. The second manifold has a plurality of outlets, which attach to the first fluid inlets 22 of each proportioning pump 10. A solenoid valve (not shown) is connected intermediate each of the outlets of the second manifold and each of the first fluid inlets 22 of the proportioning pumps 10. The solenoid valves open in response to the pressing of selector buttons 16 by an operator.

For example, the operator may press a selector button 16 which indicates that a carbonated cola drink will be dispensed. This activates the solenoid valve which supplies carbonated water to the particular proportioning pump 10 to which cola syrup is supplied as the second fluid. Thus, pressing the cola drink selector button 16 causes pressurized carbonated water to be supplied to the particular proportioning pump to which cola syrup is also supplied. The carbonated water drives the proportioning pump, thereby delivering proportionally metered quantities of both carbonated water and cola syrup to the nozzle 18.

The second fluid is supplied directly to each proportioning pump without the use of a manifold or solenoid. The second fluid 86 on each proportioning pump typically connects to a different second fluid such as cola syrup, orange syrup, lemon syrup, etc. Thus, a variety of soft drink may be disposed. The second fluids typically are not pressurized and are pumped through the proportioning pump 10 by the action of the second piston 70.

It is understood that the exemplary proportioning pump described herein and shown in the drawings represents only a presently preferred embodiment of the invention. Indeed, various modifications and additions may be made to such embodiment without departing from the spirit and scope of the invention. For example, the shape and relative positioning of the first and second pistons can be varied considerably without changing the basic function of the proportioning pump. Also, various valve means may be utilized to control fluid flow through both the first and second cylinders. Indeed, virtually any type of positive displacement pump can be used in the present invention. Thus, these and other modifications and additions may be obvious to those skilled in the art and may be implemented to adapt the present invention for use in a variety of different applications.

What is claimed is:

1. A method for mixing and dispensing first and second fluids, said method comprising the steps of:

spraying a first fluid from a first aperture into a mix chamber of a nozzle;

spraying a second fluid form a second aperture into the mix chamber of the nozzle in a direction wherein the second fluid is incident upon said first aperture; and wherein the spraying of the second fluid such tat it is incident upon said first aperture facilitates the cleaning of the first aperture.

2. A method for mixing and dispensing first and second fluids, said method comprising the steps of:

spraying a first fluid from a first aperture into a mixing chamber of a nozzle;

spraying at least one second fluid form at least one second aperture into the mixing chamber of the nozzle;

diverting a portion of the first fluid flowing to the first aperture into an accumulator; and spraying the portion of the first fluid received into the accumulator from a third aperture into the mixing chamber of the nozzle in a manner wherein the portion of the first fluid sprayed therefrom is incident upon said at least one second aperture;

wherein the portion of the first fluid sprayed from said third aperture cleans said at least one second aperture.

3. The method of claim 2 further comprising the step of flowing the first fluid through a restriction prior to spraying the first fluid from the first aperture, the flow through the restriction begin operable to divert the portion of the first fluid into the accumulator.

4. A nozzle for mixing and dispensing first and second fluids, said nozzle comprising;

a mix chamber;

a first aperture formed within the nozzle for dispensing a first fluid into the mix chamber; and at least one second aperture formed within the nozzle for dispensing at least one second fluid into the mix chamber;

said first aperture being configured and oriented within the nozzle such that the first fluid dispensed therefrom is incident upon said at leas one second aperture for purposes of cleaning said at least one second aperture.

5. A nozzle for mixing and dispensing first and second fluids, said nozzle comprising:

a mix chamber;

a first aperture formed within the nozzle for dispensing a first fluid into the mix chamber;

at least one second aperture formed within the nozzle for dispensing at leas tone second fluid into the mix chamber;

an accumulator for receiving a portion of said first fluid;

a fluid restriction through which said first fluid flows prior to being dispensed form said first aperture, said fluid restriction being operable to divert the portion of said first fluid into said accumulator; and a third aperture formed within the nozzle for dispensing the portion of said first fluid form the accumulator into the mix chamber;

said third aperture being configured and oriented within the nozzle such that the portion of said first fluid dispensed therefrom is incident upon said at least one second aperture for purposes of cleaning said at least one second aperture.

6. A nozzle for mixing and dispensing first and second fluids, said nozzle comprising:

a mix chamber;

a first fluid inlet;

a first aperture formed within the nozzle for dispensing a first fluid from the first fluid inlet into the mix chamber;

at least one second fluid inlet;

at least one second aperture formed within the nozzle for dispensing at leas one second fluid form the second fluid inlet into the mix chamber;

an accumulator inlet fluidly connected to said first fluid inlet;

an accumulator for receiving a portion of said first fluid from said first fluid inlet;

a fluid restriction disposed within said first fluid inlet adjacent said first aperture for diverting the portion of the first fluid form the first fluid inlet into the accumulator via said accumulator inlet;

an accumulator outlet fluidly connect to the accumulator; and a third aperture formed within the nozzle for dispensing the portion of said first fluid form the accumulator outlet into the mix chamber;

said third aperture being configured and oriented within the nozzle such that the portion of said first fluid dispensed therefrom is incident upon said at least one second aperture for purposes of cleaning said at least one second aperture.

* * * * *